US007481633B2

(12) United States Patent
White, Jr.

(10) Patent No.: US 7,481,633 B2
(45) Date of Patent: Jan. 27, 2009

(54) ROTOR WITH CUT-OUTS

(75) Inventor: Hollis N. White, Jr., Hopkinsville, KY (US)

(73) Assignee: White Drive Products, Inc., Hopkinsville, KY (US)

( * ) Notice: Subject to any disclaimer, the term of this patent is extended or adjusted under 35 U.S.C. 154(b) by 239 days.

(21) Appl. No.: 11/424,425

(22) Filed: Jun. 15, 2006

(65) Prior Publication Data

US 2007/0292295 A1 Dec. 20, 2007

(51) Int. Cl.
*F01C 1/10* (2006.01)

(52) U.S. Cl. ..... 418/61.3; 418/190

(58) Field of Classification Search ..... 418/61.3, 418/190, 189

See application file for complete search history.

(56) References Cited

U.S. PATENT DOCUMENTS 3,775,031 A 11/1973 Hansen
3,876,343 A * 4/1975 Giversen ..... 418/61.3
3,917,437 A * 11/1975 Link ..... 418/61.3
3,953,160 A * 4/1976 Bottoms ..... 418/190
4,145,167 A * 3/1979 Baatrup ..... 418/61.3
4,233,005 A * 11/1980 Bottoms et al. ..... 418/190
4,859,160 A 8/1989 White, Jr.
5,215,453 A * 6/1993 Petersen et al. ..... 418/61.3
6,126,424 A 10/2000 Wenker et al.
6,425,807 B2 * 7/2002 White ..... 451/47
2002/0159905 A1 * 10/2002 Bachmann et al. ..... 418/61.3
2005/0180873 A1 * 8/2005 Hansen et al. ..... 418/61.3
2006/0067848 A1 3/2006 Andersen et al.

* cited by examiner

*Primary Examiner*—Thomas E Denion
*Assistant Examiner*—Mary A Davis
(74) *Attorney, Agent, or Firm*—Fay Sharpe LLP

(57) ABSTRACT

A gerotor device having a rotor and a stator, the rotor including a plurality of teeth defining a profile, each tooth being divided by a tooth axis. At least one tooth includes an inner recess and an outer recess spaced from the inner recess along the profile.

20 Claims, 6 Drawing Sheets

ROTOR WITH CUT-OUTS

BACKGROUND

Hydraulic devices are excellent for transferring large amounts of torque into remote locations. The torque is generated by capturing a pressurized fluid within an expanding gerotor cell. The gerotor cells are defined by the contact between the teeth of a rotor and the lobes of a surrounding stator. This contact divides the pressure arc between the rotor and the stator into a series of gerotor cells.

Among the performance characteristics that are considered important in low-speed, high-torque gerotor motors are volumetric efficiency and smooth operation. When the motor, especially a hydraulic motor of the spool valve type, is operated at a low speed and a high torque, if there was a substantial amount of leakage, the motor tends to run roughly. Such inconsistency can result in rough operation of the associated piece of equipment driven by the gerotor motor.

BRIEF DESCRIPTION

An example of a hydraulic device that overcomes the aforementioned shortcomings includes a rotor and a stator. The rotor includes a plurality of teeth defining a profile. Each tooth is divided by a tooth axis. At least one tooth includes an inner recess and an outer recess spaced from the inner recess along the profile. The recesses are formed in a peripheral surface of the tooth on the same side of the tooth axis.

Another example of a hydraulic device includes a gerotor device having a rotor having n and teeth and a stator having n+1 lobes. The rotor teeth and the stator lobes cooperate with one another to define expanding and contracting fluid pockets as the rotor rotates with respect to the stator. Each tooth is divided by an axis and includes a first inner recess formed in a peripheral surface on a first side of the axis, a second inner recess formed in a peripheral surface on a second side of the axis, a first outer recess formed in a peripheral surface on the first side of the axis, and a second outer resource formed in a peripheral surface on the second side of the axis.

Another example of such a device includes a gerotor device comprising a rotor and a stator. The rotor includes a plurality of teeth defining a profile and the stator including a plurality of lobes. The rotor teeth and the stator lobes cooperate with one another to define expanding and contracting fluid pockets that include minimum volume transition pockets and maximum volume transition pockets as the rotor rotates with respect to the stator. Each tooth is divided by a tooth axis and includes a first recess and a second recess spaced from the first recess along the profile on the same side of the tooth axis. The first recesses are configured to permit fluid communication between the maximum volume transition pocket and an adjacent expanding fluid pocket as the maximum volume transition pocket approaches maximum volume. The second recesses are configured to permit fluid communication between the minimum volume transition pocket and an adjacent contracting fluid pocket as the minimum volume transition pocket approaches minimum volume.

DETAILED DESCRIPTION

Figure 1:
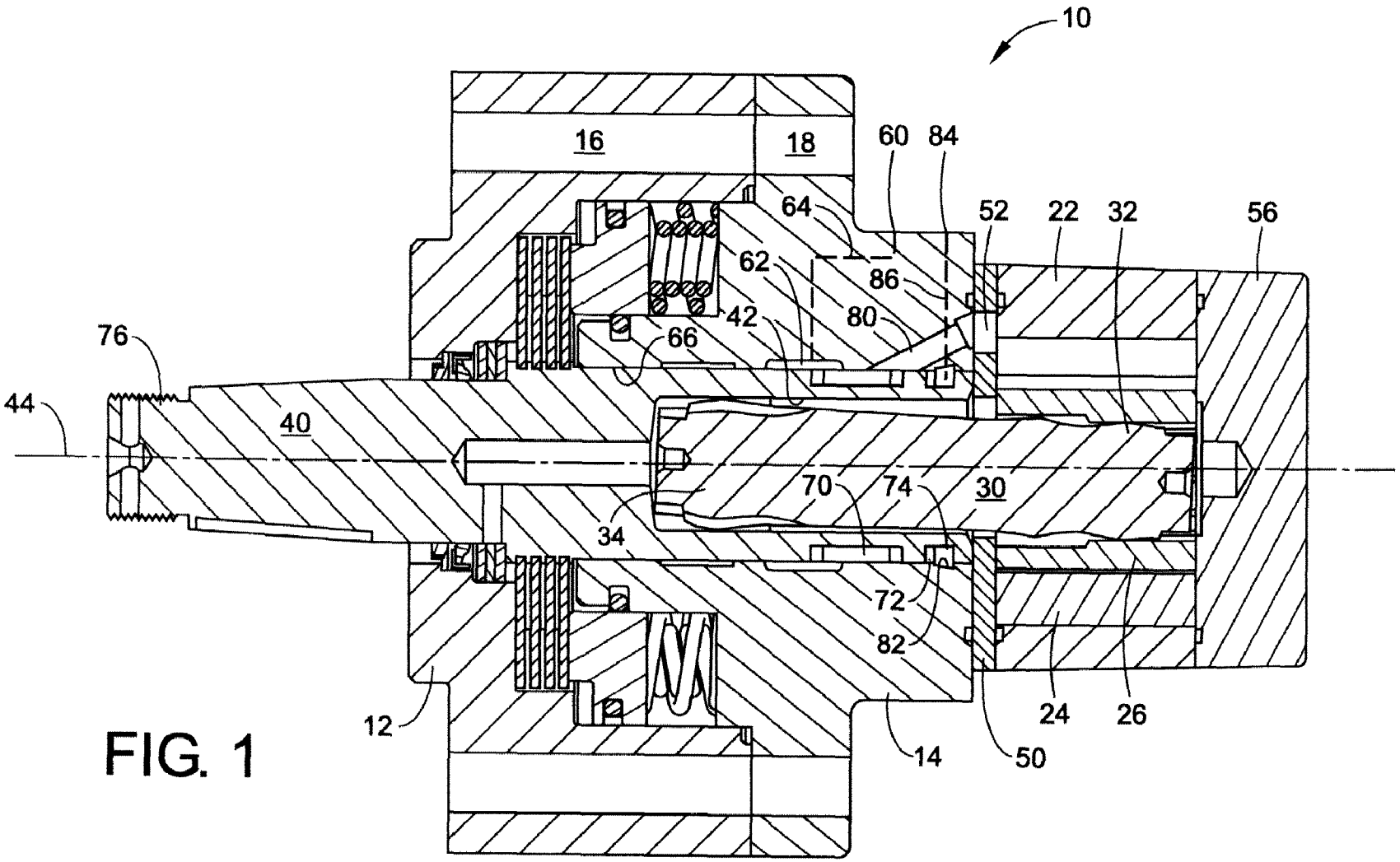
FIG. 1 is a cross-sectional view of a gerotor device.

With reference to FIG. 1, a hydraulic gerotor device 10 includes a housing assembly that includes a front housing section 12 and a rear housing section 14. The housing sections attach to one another via bolts (not shown) received in bolt holes 16 and 18 formed in the housing sections. A rotor assembly 22 connects to the rear housing section 14. In the depicted embodiment, the rotor assembly 22 includes a stator 24 and a rotor 26, which will be described in more detail below. A wobble stick 30, also referred to as a drive link or a wobble shaft, connects to the rotor 26 at a first end 32. The wobble stick 30 can attach to the rotor 26 via a splined connection, which is known in the art. The first end 32 of the wobble stick 30 rotates and orbits relative to the stator 24 as the rotor 26 rotates and orbits relative to the stator. A second end 34 of the wobble shaft 30 connects to an output shaft 40. The output shaft 40 includes a central opening 42 aligned along its rotational axis 44. The wobble stick 30 attaches to the output shaft 40 via a splined connection, which is known in the art. Orbital movement of the rotor 26 relative to the stator 24 is translated into rotational movement of the output shaft 40 about its rotational axis 44. A wear plate 50 is sandwiched between the rear housing section 14 and the rotor assembly 22. The wear plate 50 includes a plurality of openings 52 radially spaced from the rotational axis 44 of the output shaft 40. The openings 52 in the wear plate 50 communicate with the cells (either expanding or contracting) formed in the rotor assembly in a manner that is known in the art. Accordingly, the number of openings 52 equals the number of cells. An end plate 56 attaches to the gerotor assembly 22 on an opposite side of the gerotor assembly as the wear plate 50. In the depicted embodiment, the end plate 56 closes the housing assembly for the moveable components of the device 10.

When the hydraulic device 10 operates as a motor, rotation of the output shaft 40 is caused by delivering pressurized fluid to the expanding cells of the rotor assembly 20. The hydraulic device 10 can also operate as a pump when the output shaft 40 is driven by an external power device, for example a gasoline or diesel engine. A first port 60 (depicted schematically) communicates with a fluid source (not shown) and a first annular groove 62 formed in the rear housing section 14 via a passage 64 (depicted schematically). The first annular groove 62 extends radially outward from and directly communicates with a central opening 66 formed in the rear housing section 14 that receives the output shaft 40, The output shaft 40 acts as a spool valve in that it includes first axial slots 70 and second axial slots 72. The axial slots are also referred to as timing slots or feed slots in the art. The second axial slots 72 communicate with an annular groove 74 formed in the output shaft 40 adjacent an end that is opposite an output end 76 that attaches to an associated device, for example a wheel or an engine. Fluid enters the pockets in the rotor assembly 22 via the openings 52 in the wear plate 50 on one side of the line of eccentricity of the rotor assembly and exits the rotor assembly via openings 52 in the wear plate 50 on the opposite side of the line of eccentricity. The first annular groove 62 selectively communicates with the first axial slots 70 formed in the output shaft 54. Generally axially aligned passages 80 (one shown in FIG. 1) extend between the central opening 66 of the rear housing section 14 and the appropriate openings 52 in the wear plate 50. The axially aligned passage 80 communicates with the central opening 66 of the rear housing section 14 at a location that is axially spaced from the first annular groove 62 while allowing for communication with the axial slots 70 and 72 of the output shaft 40 as the output shaft rotates. A second annular groove 82 formed in the rear housing section 14 communicates with the second set of axial slots 72 formed in the output shaft 40 and the openings 52 in the wear plate. The second annular groove 82 in the rear housing section 14 communicates with an outlet port 84 via a passage 86 (both depicted schematically in FIG. 1). Flow through such a hydraulic device 10 is understood by those skilled in the art.

Figure 2:
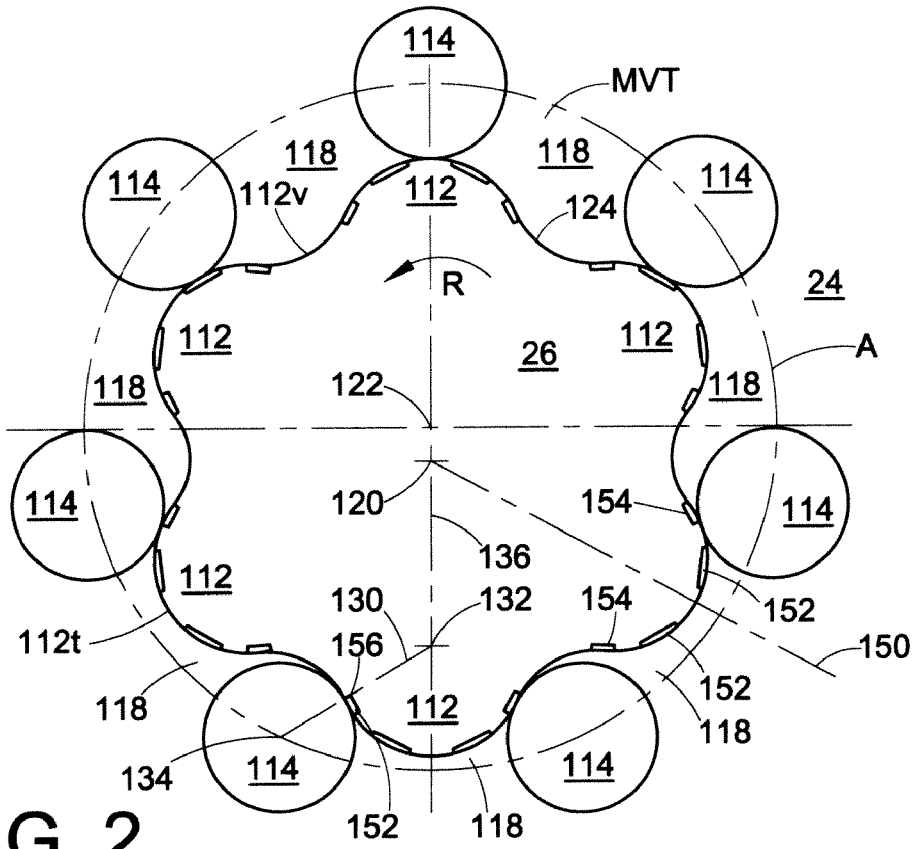
FIG. 2 is a schematic cross-sectional view of a gerotor set for the gerotor device of FIG. 1 taken at a first instant of time (top dead center) where a rotor rotates and orbits with respect to a stator.

With reference to FIG. 2, the rotor 26 (depicted schematically in FIG. 2) includes n teeth 112 and the stator 24 (depicted schematically in FIG. 2) includes n+1 lobes 114. Each tooth includes an apex, or tip, 112*t* which is rounded in the depicted embodiment, and a valley 112*v* (see also FIG. 8). In the depicted embodiment, the rotor 26 has six teeth and the stator 24 has seven lobes; however, a different number of teeth and lobes can be provided. Also, in the depicted embodiment, the lobes of the stator are rollers; however, the stator can be a unitary piece having no moving parts. In the gerotor device, the rotor 26 is located slightly off-center within the stator 24 for rotational and orbital motion. The depicted embodiment will be described as a motor where the rotor 26 rotates counterclockwise (arrow R) about a rotational axis 120 and orbits clockwise about a stator axis 122. If the hydraulic device 10 is operated as a pump these directions would be reversed.

Figure 3:
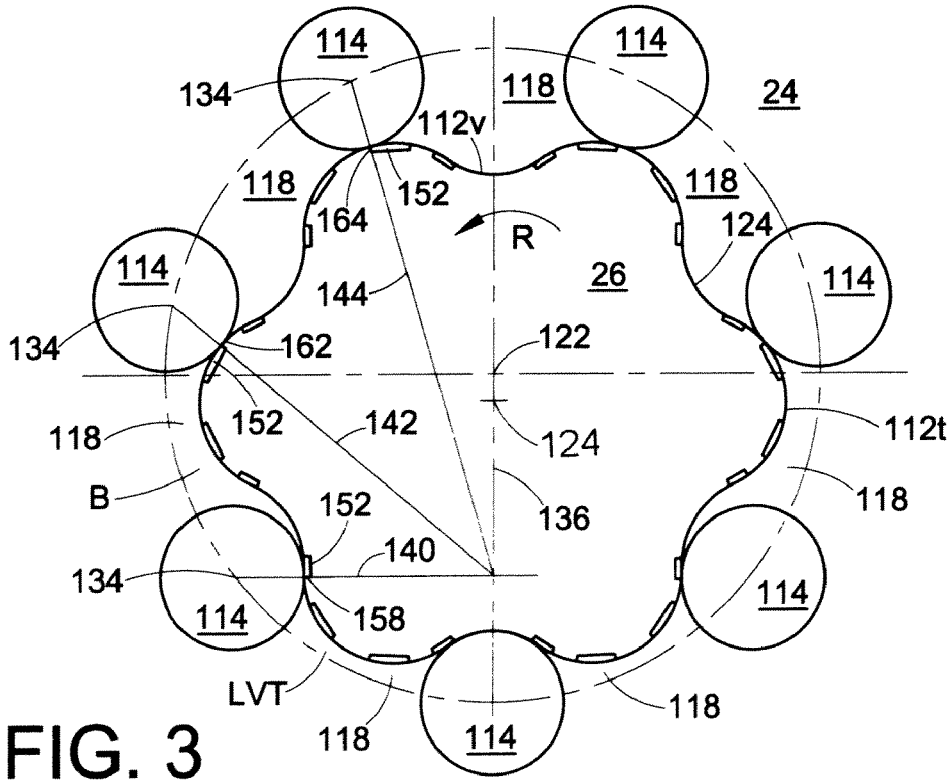
FIG. 3 is a view similar to FIG. 1 taken at a second instant in time (bottom dead center).

The rotor 26 has an outer peripheral surface 124 that, except for the cutaways or recesses later defined, has a generated shape, which is typically referred to as its profile. The profile of a known rotor includes points of inflection only at the apex and valleys of the teeth of the rotor, i.e. it does not include any recesses. With reference back to the depicted embodiment, as the rotor 26 rotates and orbits within the stator 24, the teeth 112 of the rotor variably contact, or come very close, i.e., 0.002-0.010 inches from, the rollers (referred to above as lobes 114) of the stator 24 to define expanding and contracting fluid pockets 118. FIG. 2 depicts an instant in time of orbital and rotational movement of the rotor 26 with respect to the stator 24 known in the art as top dead center where the fluid pocket 118 depicted at the six o'clock position in FIG. 2 is closed (minimum volume). FIG. 3 depicts a second instant in time of orbital and rotational movement of the rotor 26 with respect to the stator 24, which is known in the art as bottom dead center. More particularly, FIG. 3 depicts the fluid pocket 118 at the 12 o'clock position being in transition between a return (contracting) pocket and a pressure (expanding) pocket and at its highest volume.

With reference to FIGS. 2 and 3, when the geroter set is located at bottom dead center (FIG. 2) and at top dead center (FIG. 3) lines of action, which are described below, generally define the edges of expanding and contracting fluid pockets 118. With reference to FIG. 2, when the geroter set is bottom dead center, a first line of action 130 defines an edge of the closed (minimum volume) pocket 118 at the six o'clock position. The first line of action 130 intersects a pivot point 132 located a distance substantially equal to six times the offset of the rotational axis 120 of the rotor 26 from the central axis 122 of the stator 24 (six being the number of rotor teeth) and a central axis 134 of the respective roller 114. Because of the symmetry of the rotor 26, an additional line of action (not shown), which is the mirror image of the first line of action 130, can also be drawn on the opposite side of the line of eccentricity 136. These lines of action generally define the edges of the closed pocket.

In FIG. 3, when the geroter set is top dead center, three lines of action 140, 142 and 144 are depicted on one side of a line of eccentricity 136 of the rotor 26. Because of the symmetry of the rotor 26, three additional lines of action (not shown), which are mirror images to the three depicted lines of action, can also be drawn on the opposite side of the line of eccentricity 136. Each line of action 140, 142 and 144 intersects the pivot point 132, which has moved with respect to its position depicted in FIG. 2 but is still located a distance substantially equal to six times the offset of the rotational axis 120 from the orbital axis 122, and a central axis 134 of a respective roller 114 to generally define the edges of respective fluid pockets. More specifically, the second line of action 140 and the third line of action 142 define a contracting pocket 118 (specifically referred to as pocket B in FIG. 3) and the third line of action 142 and the fourth line of action 144 define a contracting pocket that is in direct communication with the return port 84 (FIG. 1) at the particular instant in time.

In the depicted embodiment, each tooth 112 of the rotor 26 is cutaway, e.g. includes a recess, spaced along the profile of the rotor. In the depicted embodiment, each tooth of the rotor has the same configuration; however, the invention is not limited to each tooth having the same configuration.

With reference back to FIG. 2, each tooth 112 is bisected by a central tooth axis 150 (only one shown at the four o'clock position in FIG. 2 for clarity) that emanates from the rotational axis 120 of the rotor 26. Each tooth 112 includes two inner recesses 152 disposed on opposite sides of the tooth axis 150. Each inner recess 152 extends inwardly, i.e., towards the central axis 120 of the rotor 26, about 0.002 to about 0.010 inches. Each tooth 112 also includes two outer recesses 154 disposed on opposite sides of the tooth axis 150. Each outer recess 154 extends inwardly, i.e., towards the central axis 120 of the rotor 26, about 0.002 to about 0.010 inches.

In the depicted embodiment, the edges of the recesses are generally defined by the lines of action. With reference to FIG. 2, the first line of action 130 defines an outer edge 156 (with respect to the tooth axis) of an outer recess 154. Since the tooth axis 150 bisects the tooth and the rotor is symmetric about the line of eccentricity 136 an outer edge of the opposite outer recess can be determined.

With reference to FIG. 3, the second line of action 140 defines an inner edge 158 (with respect to the tooth axis) of an outer recess 154. The third line of action 142 defines an outer edge 162 (with respect to the tooth axis) of an inner recess 152. The fourth line of action 144 defines an inner edge 164 of an inner recess 152. Since the teeth are symmetric about their respective tooth axes, which bisects each tooth and extends through the rotational axis 120 of the rotor 26, and the rotor 26 is symmetric about the line of eccentricity 136, all the edges of the respective recesses have been defined.

Each of the aforementioned recesses can extend the entire depth, i.e. axial dimension, of the rotor 26. Also, each of the aforementioned recesses can extend only a portion of the depth of the rotor, thus defining notches in the profile of the rotor. Moreover, more than one notch can be provided at the same location along the profile of the rotor.

The shape of the profile of the rotor can be slightly different than a typical profile that only includes cut outs. For example, in the area of the tooth apex the rotor may be slightly overformed, e.g. the rotor profile can extend 0.0001-0.0002 inches beyond the typical profile. The portion of the rotor profile between the inner recesses and the outer recesses can be slightly underformed, e.g. the rotor profile can extend 0.0002-0.0003 inches inwardly from a typical rotor profile. The overformed portions can promote closing of the fluid pockets and the underformed portions can allow the stator rollers to relax and lubricate. The changes in rotor profile also provide smoother transitions.

Each of the aforementioned recesses can extend along the profile a distance, for example 0.005 inches, beyond the corresponding line of action that generally defines the edge of the respective recess. In other words, a slight overlap of the recess beyond the line of action may exist to define an offset. This slight overlap promotes fluid communication between adjacent fluid pockets in the gerotor device, which will be described in more detail below. Where a slight overlap exists, lands 112*l* (FIG. 8), which are disposed between adjacent inner and outer recesses (recesses can be circumferentially spaced, i.e., along the profile, and axially spaced, i.e., along the depth), close off the fluid pockets 118 of the device. The lands 112*l* can also increase the durability of the rotor, as compared to a rotor having a single recess on each side of the tooth axis.

Figure 4:
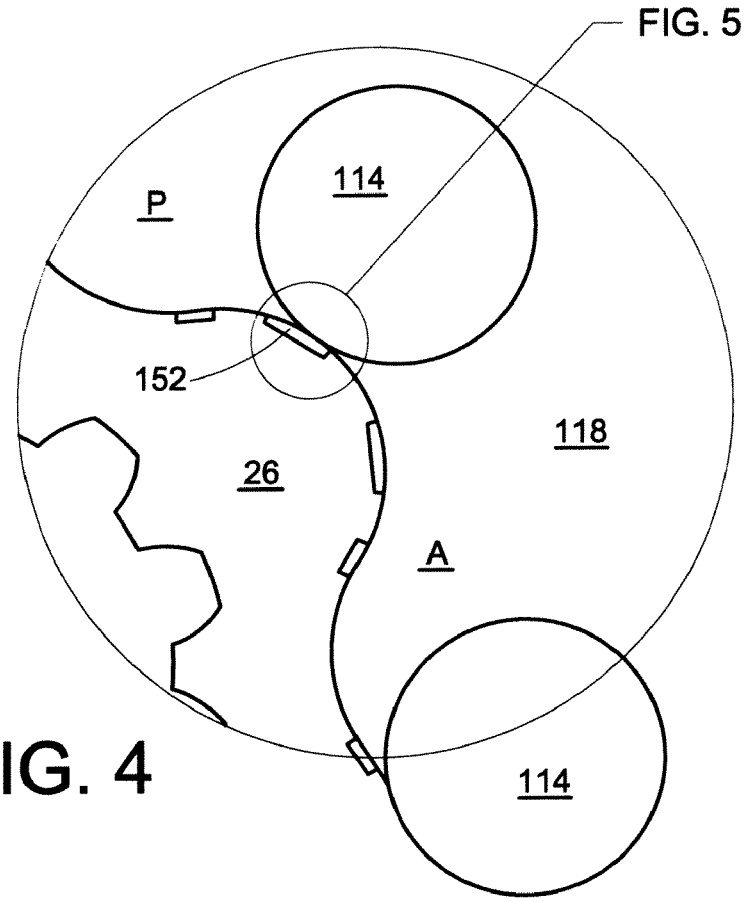
FIG. 4 is a close up view of a portion of the geroter set depicted in FIG. 2 after having transitioned 1/168 orbit from top dead center.
Figure 5:
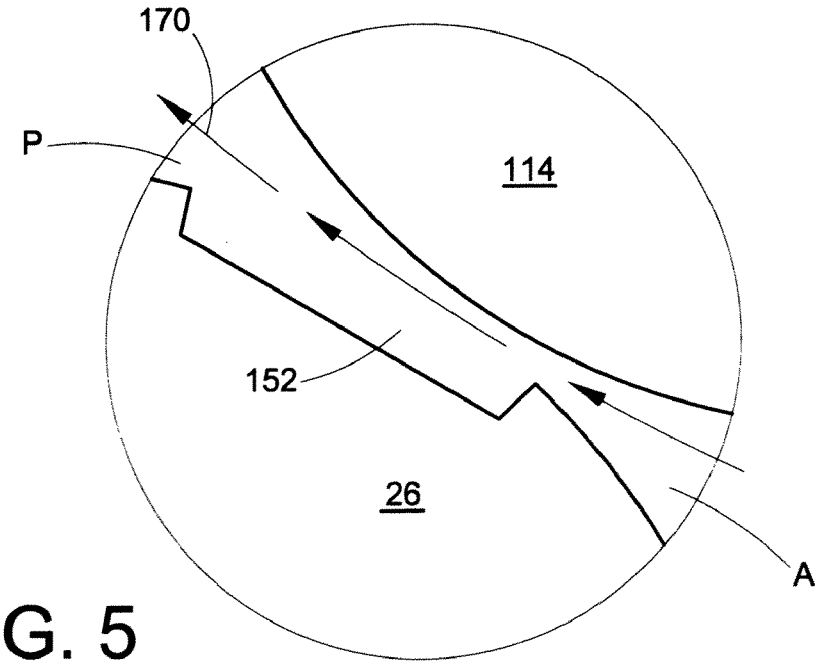
FIG. 5 is a close up view of the circled portion of FIG. 4.

With reference to FIG. 2, with the rotor at top dead center, the shaft valving slots 70 (FIG. 1) covering in the rear housing section 14 (FIG. 1) have just started to close. If the gerotor device is operating at high pressures, the drive link 30 (FIG. 1) that is attached to the rotor can twist up to four (4) or five (5) degrees, which can result in incorrect timing. In the depicted embodiment, after the valving slots have closed, the maximum volume transition pocket MVT (in the clockwise direction from the roller 114 at the twelve o'clock position in FIG. 2) is fed from pressurized expanding pocket A (located generally between the two o'clock position and three o'clock position in FIG. 2) through one of the inner recess 152 (see FIGS. 4 and 5 which depict a transition from top dead center after 1/168 orbit) to accommodate for a timing error. Fluid can travel through the inner recess 152 in the direction depicted by arrows 170 (FIG. 5) to continue to supply pressurized fluid to the near fully expanded pocket MVT after the valving slots 70 (FIG. 1) have closed.

Figure 6:
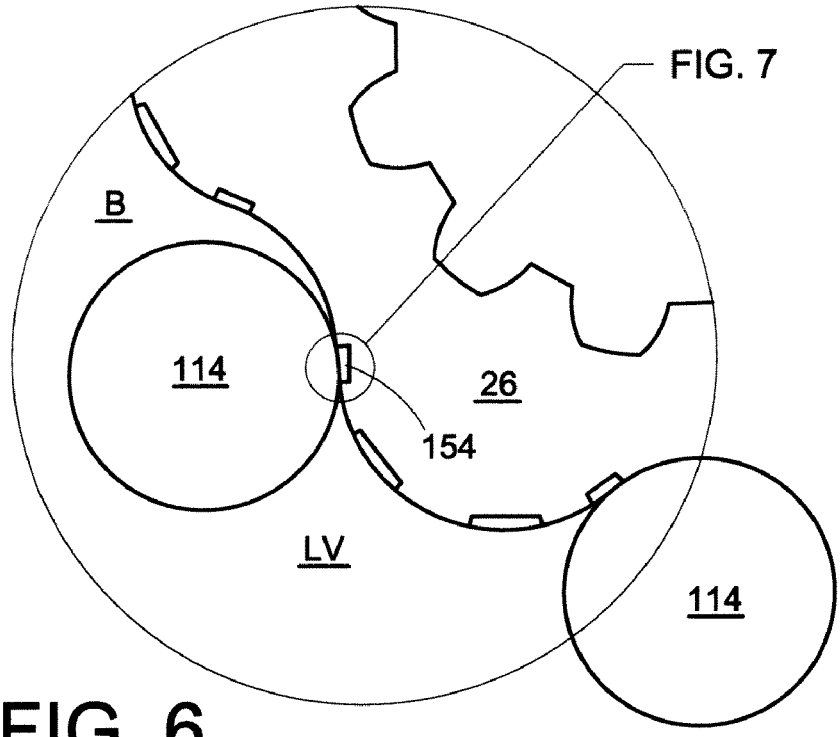
FIG. 6 is a close up view of the gerotor set depicted in FIG. 3 after having transitioned 1/168 orbit from bottom dead center.
Figure 7:
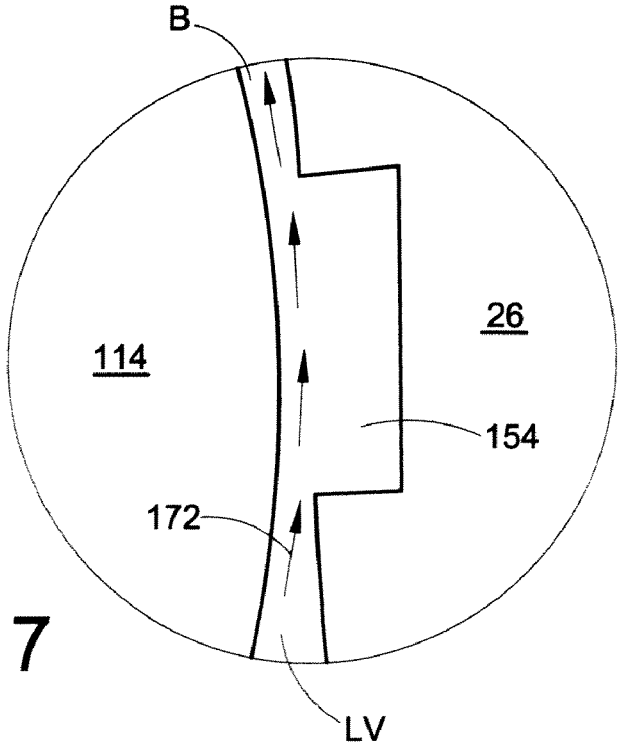
FIG. 7 is a close up view of the circled portion of FIG. 6.

With reference to FIG. 3, with the rotor at bottom dead center, the shaft valving slots 72 (FIG. 1) covering in the rear housing section 14 (FIG. 1) have just started to close. After closing, the pocket going into minimum (lowest) volume transition pocket LVT (in the clockwise direction from the roller 114 at the six o'clock position in FIG. 3) feeds contracting pocket B through one of the outer recess 154 (see also FIGS. 6 and 7 which depict a transition from bottom dead center after 1/168 orbit). Fluid can travel through the outer recess 154 in the direction depicted by arrows 172 (FIG. 7) to continue to supply return fluid to the pocket B after the valving slots 72 (FIG. 1) have closed.

Figure 8:
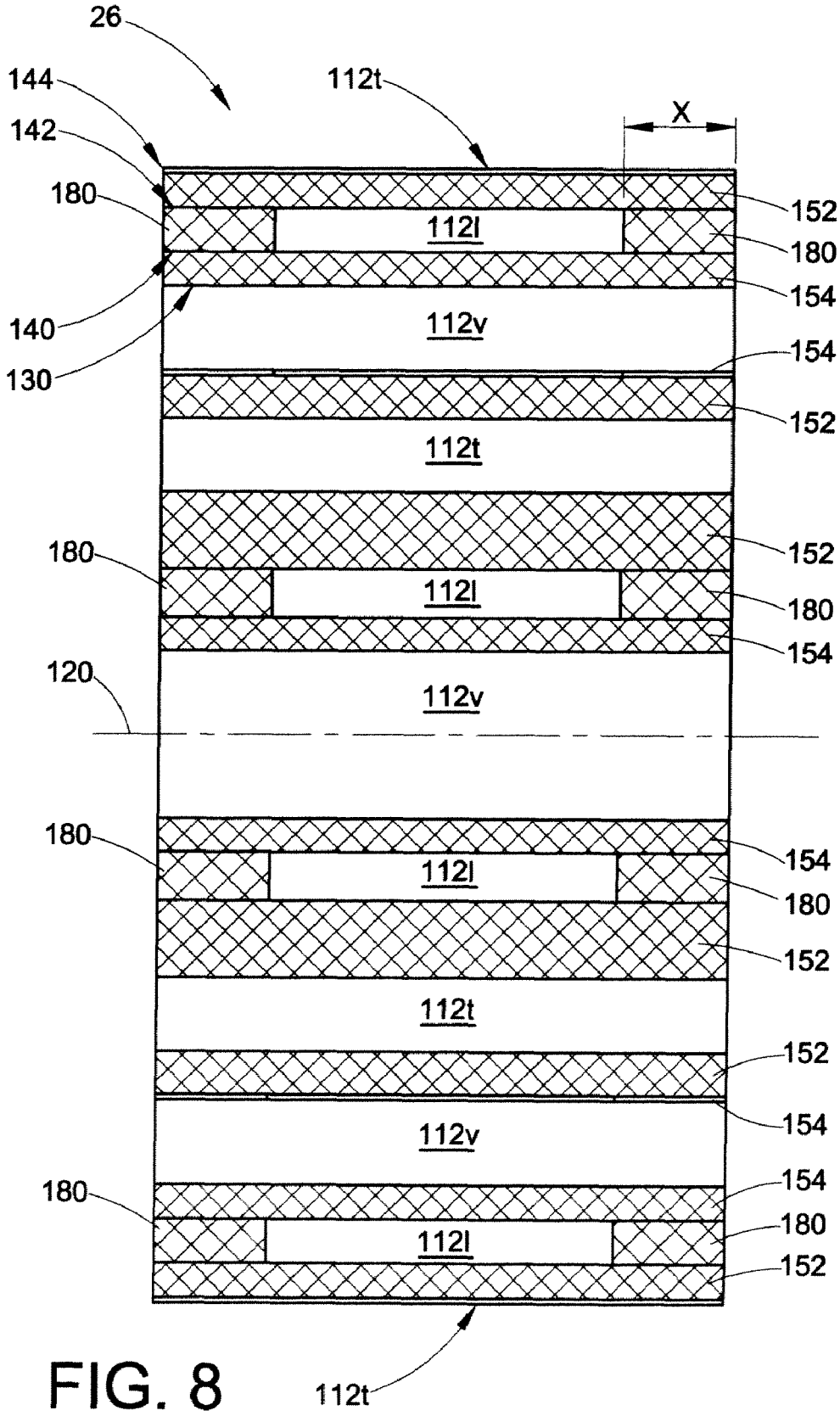
FIG. 8 is a side view of the rotor of the geroter set of FIG. 1.
Figure 9:
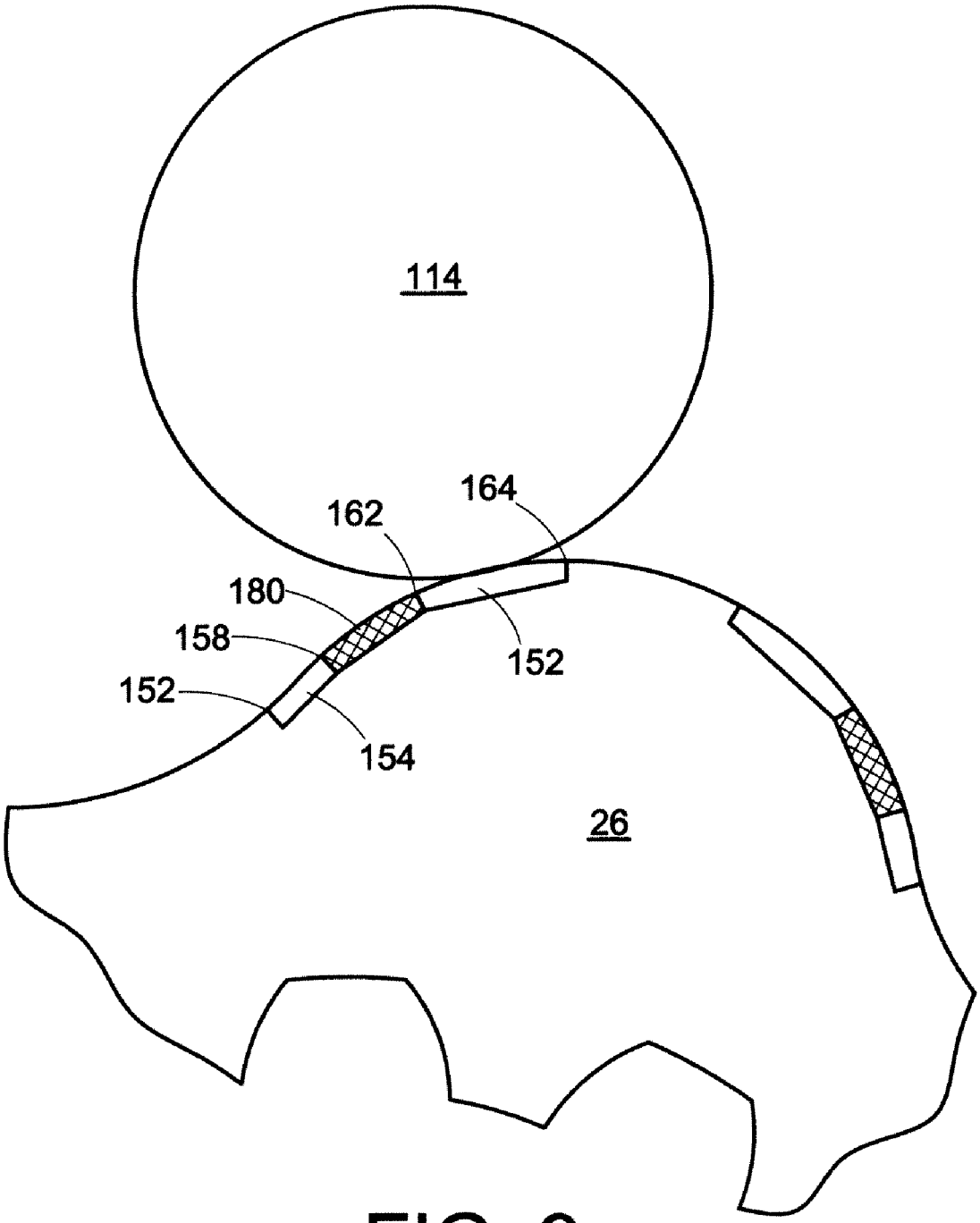
FIG. 9 is a close up view of a portion of the rotor of FIG. 8 and a roller of the geroter set of FIG. 1.

With reference to FIGS. 8 and 9, the rotor 26 can also include intermediate recesses 180 that are cut out between the second line of action 140 and the third line of action 142. In other words, the intermediate recesses 180 are formed between the inner recesses 152 and the outer recesses 154. As shown in FIG. 8, the intermediate recesses extend axially inwardly from each face of the rotor a dimension X, which can be about 20% of the depth, i.e. axial dimension, of the rotor. By providing more than one recess on each side of the tooth axis, the volume of fluid traveling between adjacent fluid pockets can be metered more effectively as compared to providing only one recess on each side of a tooth axis. By providing a land, e.g. a portion that generally follows the original profile of the rotor, between the recesses the durability of a rotor that allows fluid to pass to an adjacent pocket is increased.

A gerotor device that reduces pressure spikes in the fluid pockets has been described with reference to one embodiment. The invention is not limited to only the embodiment that has been described above. Instead, the invention is defined by the appended claims and the equivalents thereof.

The invention claimed is:

1. A gerotor device comprising:

a stator having n+1 lobes;

a rotor having n teeth, the rotor teeth and the stator lobes cooperating with one another to define expanding and contracting fluid pockets as the rotor rotates and orbits with respect to the stator, each tooth being divided by an axis and including a first inner recess formed in a peripheral surface on a first side of the axis, a second inner recess formed in a peripheral surface on a second side of the axis, a first outer recess formed in a peripheral surface on the first side of the axis, a second outer recess formed in a peripheral surface on the second side of the axis, wherein each edge of each recess is generally defined by a respective line of action; and wherein at least one of the first and second inner recess being configured to permit fluid communication between the maximum volume transition pocket and an adjacent expanding fluid pocket as the maximum volume transition pocket approaches maximum volume and at least one of the first and second outer recess being configured to permit fluid communication between the minimum volume transition pocket and an adjacent contracting fluid pocket as the minimum volume transition pocket approaches minimum volume.

2. The gerotor device of claim 1, wherein each edge of each recess is offset a distance from a respective line of action.

3. The gerotor device of claim 1, wherein each tooth includes an intermediate recess disposed between the inner recess and the outer recess.

4. The gerotor device of claim 3, wherein the intermediate recess extends from an end face of the rotor into the rotor about 20% of the depth of the rotor.

5. The gerotor device of claim 1, wherein each inner recess and at least one outer recess extends the entire depth of the rotor.

6. The gerotor device of claim 1, wherein at least one inner recess and at least one outer recess extends a portion of the entire depth of the rotor.

7. The gerotor device of claim 1, wherein each axis bisects a respective tooth.

8. The gerotor device of claim 1, wherein the lobes are rollers each having a circular cross section having no points of inflection.

9. The gerotor device of claim 8, wherein each tooth includes an apex and a valley that defines a profile for the rotor and the rotor has only one point of inflection in each valley.

10. A hydraulic device comprising:

a gerotor device comprising a rotor having n teeth and a stator having n+1 lobes, the rotor teeth and the stator lobes cooperating with one another to define expanding and contracting fluid pockets as the rotor rotates with respect to the stator, each tooth being divided by an axis and including a first inner recess formed in a peripheral surface on a first side of the axis, a second inner recess formed in a peripheral surface on a second side of the axis, a first outer recess formed in a peripheral surface on the first side of the axis, a second outer recess formed in a peripheral surface on the second side of the axis, each tooth including an apex and a valley that define a profile for the rotor; wherein at least one of the first and second inner recess being configured to permit fluid communication between the maximum volume transition pocket and an adjacent expanding fluid pocket as the maximum volume transition pocket approaches maximum volume and at least one of the first and second outer recess being configured to permit fluid communication between the minimum volume transition pocket and an adjacent contracting fluid pocket as the minimum volume transition pocket approaches minimum volume.

11. The device of claim 10, wherein n teeth include a first tooth and a second tooth adjacent the first tooth, at an instant during the movement of the rotor with respect to the stator at least one of the fluid pockets is generally defined between an inner edge of the first outer recess of the first tooth and an outer edge of the first inner recess of the second tooth.

12. The device of claim 11, wherein n teeth include a third tooth adjacent the second tooth, at an instant during the movement of the rotor with respect to the stator at least one of the fluid pockets is generally defined between an outer edge of the first inner recess of the second tooth and an inner edge of the first inner recess of the third tooth.

13. The device of claim 12, wherein n teeth including a fourth tooth adjacent the third tooth, at an instant during the movement of the rotor with respect to the stator at least one of the fluid pockets is generally defined between an inner edge of the first inner recess of the third tooth and an inner edge of the second inner recess of the fourth tooth.

14. The device of claim 10, wherein n teeth include a first tooth, at an instant during the movement of the rotor with respect to the stator an outer edge of the first outer recess of the first tooth and an outer edge of the second outer recess of the first tooth both generally define a closed fluid pocket.

15. A gerotor device comprising a rotor and a stator, the rotor including a plurality of teeth defining a profile and the stator including a plurality of lobes, the rotor teeth and the stator lobes cooperating with one another to define expanding and contracting fluid pockets that include minimum volume transition pockets and maximum volume transition pockets as the rotor rotates with respect to the stator, each tooth being divided by a tooth axis and including a first recess and a second recess spaced from the first recess along the profile on the same side of the tooth axis, the first recesses being configured to permit fluid communication between the maximum volume transition pocket and an adjacent expanding fluid pocket as the maximum volume transition pocket approaches maximum volume, the second recesses being configured to permit fluid communication between the minimum volume transition pocket and an adjacent contracting fluid pocket as the minimum volume transition pocket approaches minimum volume.

16. The gerotor device of claim 15, wherein the first recess is disposed closer to the tooth axis along the profile as compared to the second recess.

17. The gerotor device of claim 15, further comprising an intermediate recess disposed between the first recess and the second recess.

18. The gerotor device of claim 17, wherein the intermediate recess extends into the rotor from a face only a portion of the entire depth of the rotor.

19. The gerotor device of claim 15, wherein the recesses extend only a portion of the axial dimension of the rotor.

20. The gerotor device of claim 15, wherein the recesses extend at least substantially the entire axial dimension of the rotor.

* * * * *